United States Patent [19]

Herzog

[11] 4,013,378

[45] Mar. 22, 1977

[54] AXIAL FLOW TURBINE EXHAUST HOOD

[75] Inventor: Josef Herzog, Scotia, N.Y.

[73] Assignee: General Electric Company, Schenectady, N.Y.

[22] Filed: Mar. 26, 1976

[21] Appl. No.: 670,876

[52] U.S. Cl. ..... 415/209; 415/219 R

[51] Int. Cl.[2] ..... F01D 1/02

[58] Field of Search ..... 415/209, 210, 211, 219 R, 415/199 R

[56] References Cited

UNITED STATES PATENTS

| | | | |
|---|---|---|---|
| 2,247,817 | 7/1941 | Mc Mahan | 415/211 |
| 2,655,307 | 10/1953 | Buckland et al. | 416/171 |
| 2,947,467 | 8/1960 | Palmer | 415/210 |
| 2,991,927 | 7/1961 | Quick | 415/210 |
| 3,552,877 | 1/1971 | Christ et al. | 415/209 |

FOREIGN PATENTS OR APPLICATIONS

| | | | |
|---|---|---|---|
| 485,159 | 9/1917 | France | 415/209 |
| 1,050,341 | 9/1953 | France | 415/199 R |
| 1,050,497 | 2/1959 | Germany | 415/209 |
| 12,163 | 11/1924 | Netherlands | 415/209 |
| 197,873 | 5/1923 | United Kingdom | 415/199 R |

*Primary Examiner*—Henry F. Raduazo
*Attorney, Agent, or Firm*—John F. Ahern; James W. Mitchell

[57] ABSTRACT

An axial flow turbine incorporating an exhaust hood for receiving exhaust steam from the turbine and directing this exhaust steam through a discharge opening in the hood in a direction essentially normal to the axis of the turbine is disclosed. The exhaust hood includes a first set of guide vanes arranged in an exhaust duct connected to the turbine adjacent the last stage buckets thereof. These vanes are curved to provide a relatively smooth transition of steam flow from an axial direction to a generally radial direction. A guide ring circumferentially surrounds the first set of guide vanes and a plurality of secondary vanes are circumferentially spaced around this guide ring. Steam which is discharged radially from the first set of vanes to the secondary vanes is directed by the secondary vanes to the discharge opening of the exhaust hood. The secondary vanes are substantially equally spaced around the guide ring and are curved at different angles to effect different angles of discharge of steam from these vanes. The angles of discharge are chosen so as to direct the steam toward the discharge opening of the exhaust hood in a manner achieving substantially uniform flow distribution across the exit plane of the last stage buckets and across the plane of the discharge opening. The secondary vanes have an axial length which is a minimum at the inner edges and increases to a maximum at the outer edges.

8 Claims, 4 Drawing Figures

AXIAL FLOW TURBINE EXHAUST HOOD

BACKGROUND OF THE INVENTION

1. Field of the Invention

The present invention relates to axial flow turbines incorporating an exhaust hood and more particularly to arrangements for improving the flow and pressure distribution in the exhaust from such turbines.

2. Description of the Prior Art

In the discharge of exhaust steam from an axial flow turbine, for example discharge of this exhaust steam to a condenser, it is desirable to provide as smooth a flow of steam as possible and to minimize energy losses from accumulation of vortices and turbulences and non-uniformity in such flow.

Usually the exhaust from the turbine is directed into an exhaust hood and from there to a condenser. It is desirable to achieve a smooth transition from axial flow at the exhaust of the turbine to radial flow in the exhaust hood and thence a smooth flow at the discharge opening of this hood into the condenser.

In the constructing of an effective exhaust hood for use with such an axial flow turbine it is desirable to avoid acceleration losses within any guide means employed therein and to achieve a relatively uniform flow distribution at the discharge opening of the exhaust hood for the most efficient conversion of energy in the turbine and effective supplying of exhaust steam to the condenser to which it is connected.

It is also desirable to achieve optimum efficiency at the last stage buckets of the turbine prior to exhaust from the turbine by achieving a relatively uniform circumferential and radial pressure distribution in the exit plane of the last stage buckets. Finally, it is desirable to accomplish these results while employing a hood having as short an axial length as possible.

The prior art has employed in the exhaust duct connected to the turbine, vanes which have smoothly curved surfaces for effectively changing the axial flow of the steam from the turbine to the generally radial flow. For example of such an arrangement for converting the axial flow of the exhaust from the turbine to radial flow is shown in U.S. Pat. No. 3,552,877 - Christ et al.

Such arrangements, however have not provided for effectively directing of the exhaust steam to the discharge opening of an exhaust hood with reduced acceleration losses and reduced losses resulting from the forming of energy-consuming vortices in the flow of the exhaust steam. Moreover, they have not effectively achieved relatively uniform circumferential and radial pressure distribution at the exit plane of the large stage turbine buckets, a consideration which is of increasing importance for buckets having high tip speeds and high exit Mach numbers.

By the present invention additional guiding and diffusing vanes are employed to effect a smooth transition from radial flow to a direction leading to the discharge opening of the exhaust hood. It has been found that the arrangement of the present invention results in a substantially uniform flow thru across the entire area of discharge opening of the exhaust hood. Moreover, the guidance of the steam flow by the arrangement of this invention has been found to minimize the generation of energy-consuming vortices and to minimize acceleration losses in the guide vanes employed in the structure of this invention. In addition, a relatively uniform pressure distribution in the exit plane of the last stage buckets is obtained. These improved results have been obtained while still employing an exhaust hood having a relatively short axial length.

Accordingly it is an object of this invention or provide an axial flow turbine incorporation an exhaust hood which achieves a substantially uniform flow distribution at the discharge opening of the exhaust hood.

It is another object of this invention to provide an axial flow turbine incorporating an exhaust flow in which acceleration losses in the fluid passing thru the hood are minimized.

It is a further object of this invention to provide an axial flow turbine incorporating an exhaust hood wherein the generation of energy consuming vortices in the flow of fluid thru the hood is minimized.

It is still a further object of this invention to provide an axial flow turbine incorporating an exhaust hood wherein a relatively uniform circumferential and radial pressure distribution in the exit plane of last stage buckets of the turbine is obtained.

SUMMARY OF THE INVENTION

The present invention is directed to an axial flow turbine incorporating an exhaust hood for receiving exhaust steam from the turbine and directing this exhaust steam through a discharge opening in the hood in a direction essentially normal to the axis of the turbine, the steam being transmitted to a condenser associated with the turbine. The exhaust hood includes a first set of guide vanes arranged in an exhaust duct which is connected to the turbine adjacent the last stage buckets thereof. These vanes are spaced within the duct and are curved to provide a relatively smooth transition of steam flow from an axial direction to a generally radial direction. A guide ring having inner and outer diameters is arranged to circumferentially surround the first set of guide vanes so as to receive exhaust steam discharge from these vanes. A plurality of secondary vanes are arranged in cicumferentially spaced relationship around the ring between the inner and outer diameters thereof. These vanes are substantially equally spaced around the guide ring and are curved at different angles to effect different angles of discharge of steam from these vanes. The angles of discharge are chosen so as to direct the steam toward the discharge opening of the exhaust hood in a manner to achieve substantially uniform flow distribution across the exit plane of the last stage buckets and the plane of the discharge opening. The vanes are also formed so as to have an increasing axial length from the inner diameter of the guide ring to the outer diameter thereof, that is the vanes have their minimum axial length at the inner diameter of the guide ring and their maximum axial length at the outer diameter.

DESCRIPTION OF THE PREFERRED EMBODIMENT

Figure 1:
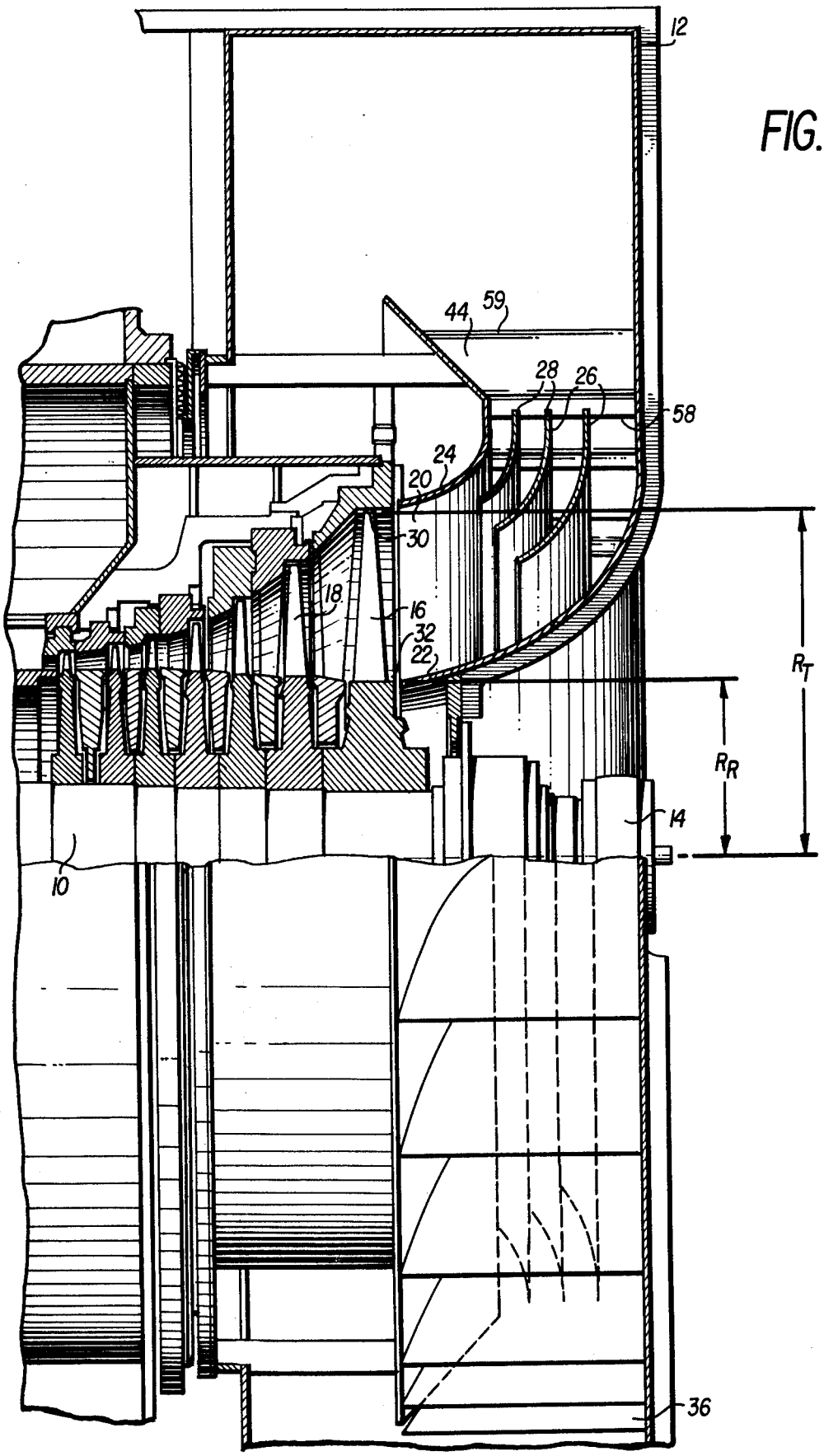
FIG. 1 is a view of a portion of an axial flow steam turbine incorporating the exhaust hood of the present invention.

In FIG. 1 there is shown a portion of an axial flow steam turbine 10 which incorporates an exhaust hood 12 constructed in accordance with the present invention. The turbine includes a conventional shaft 14 and conventional buckets mounted on the shaft. Two of the buckets have been indicated by the numerals 16 and 18, the numeral 16 indicating a last stage bucket, that is in the stage immediately preceding the exhaust of steam from the turbine.

The exhaust hood 12 includes a duct 20 which is connected to the turbine immediately adjacent the last stage and receives the axially flowing steam discharging from the last stage buckets of the turbine. The inlet of the exhaust duct is of annular shape, having an inner wall 22 of smaller diameter positioned adjacent the root of the last stage buckets and an outer wall 24 of larger diameter positioned adjacent the tip of the last stage buckets. The walls 22 and 24 of the exhaust duct are smoothly curved, as shown in FIG. 1, to direct the axially flowing discharge from the turbine into a generally radial direction. To assist in changing the direction of flow of the steam from an axial direction to a radial direction and to minimize turbulences in the flow of steam, a plurality of vanes 26 are positioned in spaced relationship between the walls 2 and 24 of the exhaust duct. These vanes 26 have the same general curvature as the walls of the exhaust duct. The outer ends 28 of all the vanes 26, that is the trailing edges thereof, are positioned at the same radial distance from the center of the shaft 14.

The number of vanes 26 to secure optimum performance varies with the ratio $R_T/R_R$, where $R_T$ is the radius at the tip 30 of the last stage buckets and $R_R$ is the radius at the root 32 of the last stage buckets. In the embodiment shown the ratio $R_T/R_R$ is approximately two and in this case it has been found that three vanes 26 should be employed. In another situation where this ratio was approximately 1.7 it has been found that two vanes should be used.

Figure 2:
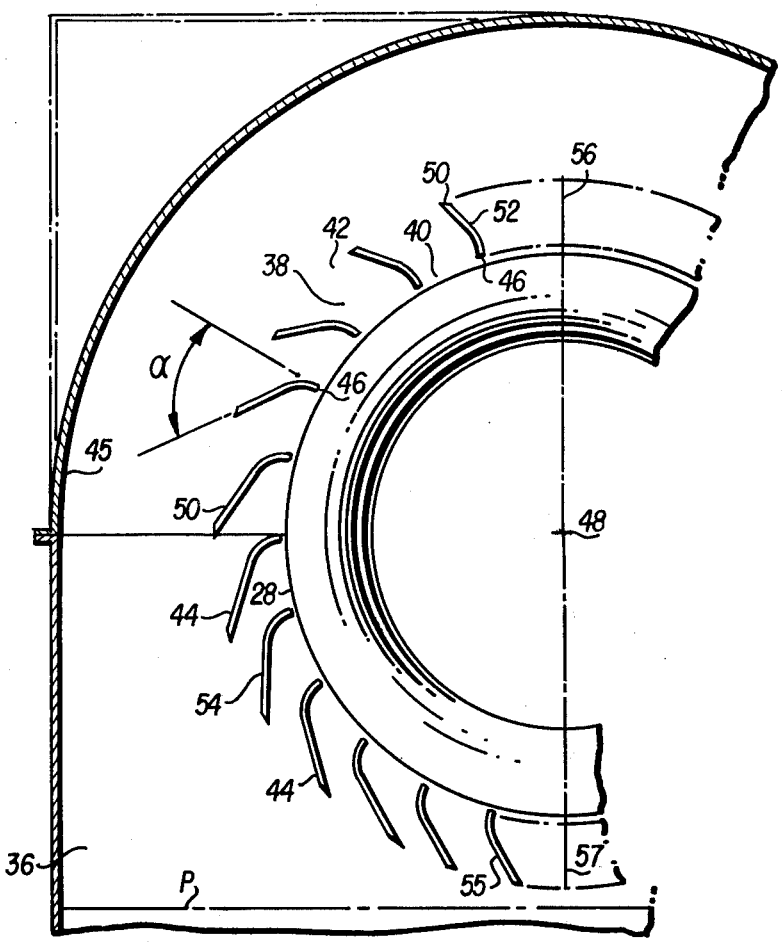
FIG. 2 is an end view, partly broken away, of the exhaust hood shown in FIG. 1.

It can be seen, by referring to FIGS. 1 and 2, that the steam discharged from trailing ends 28 of the vanes 26 will be flowing in a generally radial direction throughout the circumference of these trailing ends. It is necessary that this steam be directed with a minimum of energy-consuming vortices or turbulences and a minimum of acceleration losses into a direction generally aligned with the discharge opening 36 of the exhaust hood 12. In accordance with this invention such energy-consuming vortices and acceleration losses are minimized and the discharge from the vanes 26 is caused to be directed relatively smoothly to the discharge opening of the exhaust hood. To accomplish this, a guide ring 38 having an inner diameter 40 and outer diameter 42 is provided in the exhaust hood between the trailing ends 28 of the vanes 26 and the discharge opening 36 of the exhaust hood 12. The guide ring is positioned immediately adjacent the trailing ends 28 of the vanes 26 and circumferentially surrounds these vanes.

A plurality of secondary vanes 44 are positioned within the guide ring 38 between the inner and outer diameters thereof. These vanes 44 are substantially equally spaced circumferentially about the guide ring. While in FIG. 2, for convenience, only the vanes associated with one-half of the guide ring 38 have been illustrated, it will be understood that the vanes on the other half of the guide ring are arranged in an exact mirror image of those illustrated in FIG. 2.

As shown in FIG. 2, the vanes 44 are curved so as to cause the fluid exiting from the vanes 26 in a generally radial direction throughout the circumference thereof to be directed generally toward the discharge opening 36 of the hood 12. Some of these vanes, namely those in the lower portion of the guide ring as illustrated in FIG. 2, direct the fluid toward the opening 36 itself whereas others of the vanes, particularly those in the upper portion of the guide ring, direct the fluid toward the wall 45 of the exhaust hood and then toward the opening 36.

In the specific construction disclosed the inner or leading ends 46 of the vanes 44, that is, the ends adjacent the inner diameter 40 of the guide ring 38, are all directed radially toward a central point 48. Each of the vanes, however, in approximately the upper quadrant of the guide ring 38 has a different degree of curvature so each has a different discharge angle at its outer or trailing end 50. Thus, each secondary vane in this quadrant has a different angle $\alpha$ between the direction of the inner or leading end 46 and the direction of the outer or trailing end 50. Similarly, each of the secondary vanes in approximately the lower quadrant has a different angle $\alpha$.

This angle $\alpha$ is referred to hereinafter as the stream angle, by which is meant the angle by which the steam discharging radially from the vanes 26 is turned by each secondary vane from the radial direction in order to assist uniform flow of steam thru the discharge opening 36 of the hood 12. Stated in a different manner, the angle $\alpha$ , or stream angle, is the angle between the direction of the inner end and the direction of the outer end of a secondary vane.

It has been found that the most effective flow is achieved when the stream angle increases from a minimum at the topmost vane 52 to a maximum at a vane, for example vane 54, which is disposed between approximately 90° and 110° from the top of the guide ring and thereafter decreases progressively thru the remaining vanes in the lower quadrant to a second minimum at the lowermost vane 55.

Figure 3:
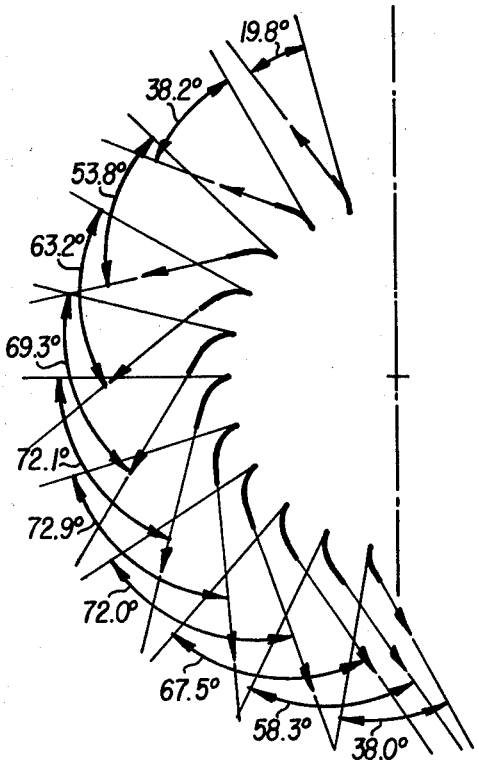
FIG. 3 is a schematic view of a portion of a guide ring employed in the exhaust hood, illustrating the angles of discharge from secondary vanes included in the guide ring.

In one specific embodiment of this invention illustrated schematically in FIG. 3, the stream angles of the vanes beginning with the topmost vane 52 and continuing successively to the lowermost vane 55 are 19.8°, 38.2°, 53.8°, 63.2°, 69.3°, 72.1°, 72.9°, 72.0°, 67.5°, 58.3° and 38°.

For optimum performance the ratio of radial vane width, this is the distance between the inner diameter 40 and the outer diameter 42 of the guide ring, and the pitch of the vanes 44 in the guide ring should be equal to or greater than 0.86. The pitch may of course, be determined by dividing the inner cicumference of the guide ring by the number of vanes 44 employed therein. In establishing the number of vanes for purposes of this calculation the top and bottom symmetry lines 56 and 57 are includes as phantom vanes with zero deflection. Thus, for purposes of this calculation the number of secondary vanes in the guide ring would be taken as 24.

In one specific embodiment the inner diameter was 115.5 inches and the outer diameter was 141.5 inches. The radial vane width was, therefore 13 inches. Including for this purpose the top and bottom symmetry lines as two vanes, we would consider 24 vanes as being employed. Dividing the inner circumference of 362.9 inches by 24 gives a pitch of 15.12 inches. The ratio of radial vane width to pitch was therefore 0.86.

In order to avoid choking the exhaust hood in the higher velocity region and to mimizize acceleration losses the secondary vanes 44 are constructed so as to have a mimimum axial length 58 at the inner diameter 40 of the guide ring and a maximum axial length 59 at the outer diameter 42 of the guide ring, the axial length increasing linearly from the inner diameter to the outer diameter. As can be best seen by referring to FIG. 1, this construction of the secondary vanes 44 allows a lateral diffusion of the steam passing along the vanes 44 as the direction of flow of the steam is changed by the vanes 44 to direct it toward the discharge opening 36 of the hood 12. Such lateral diffusion minimizes acceleration losses and avoids choking the exhaust hood in the high velocity regions.

By the construction of the guide ring 38 and the vanes 44 therein the fluid discharged from the vanes 26 is directed toward the discharge opening 36 in such a manner that the flow of fluid across the full extent of the discharge opening, including additional exhaust area due to annulus advance A, for example at a plane indicated by the legend P, is substantially uniform.

Thus in the turbine and exhaust hood contruction of the present invention fluid, that is steam, being discharged from the last stage buckets of the turbine 10 in an axial direction is first redirected by the vanes 26 to a generally radial direction throughout the circumference of the trailing ends 28 of the vanes 26. This radial flow is then diverted by the secondary vanes 44 in the guide ring 38 smoothly into directions causing the steam to be directed to the discharge opening 36 of the hood 12 in a manner achieving substantially uniform flow throughout the full area of the discharge opening and also achieving substantially uniform flow distribution across the exit plane of the last stage buckets. At the same time as this change in direction of the steam is being effected, the increasing axial length of the vanes 44 referred to above effects a diffusion of the steam so as to minimize acceleration losses and to avoid choking of the hood in the regions of high velocity discharge.

Figure 4:
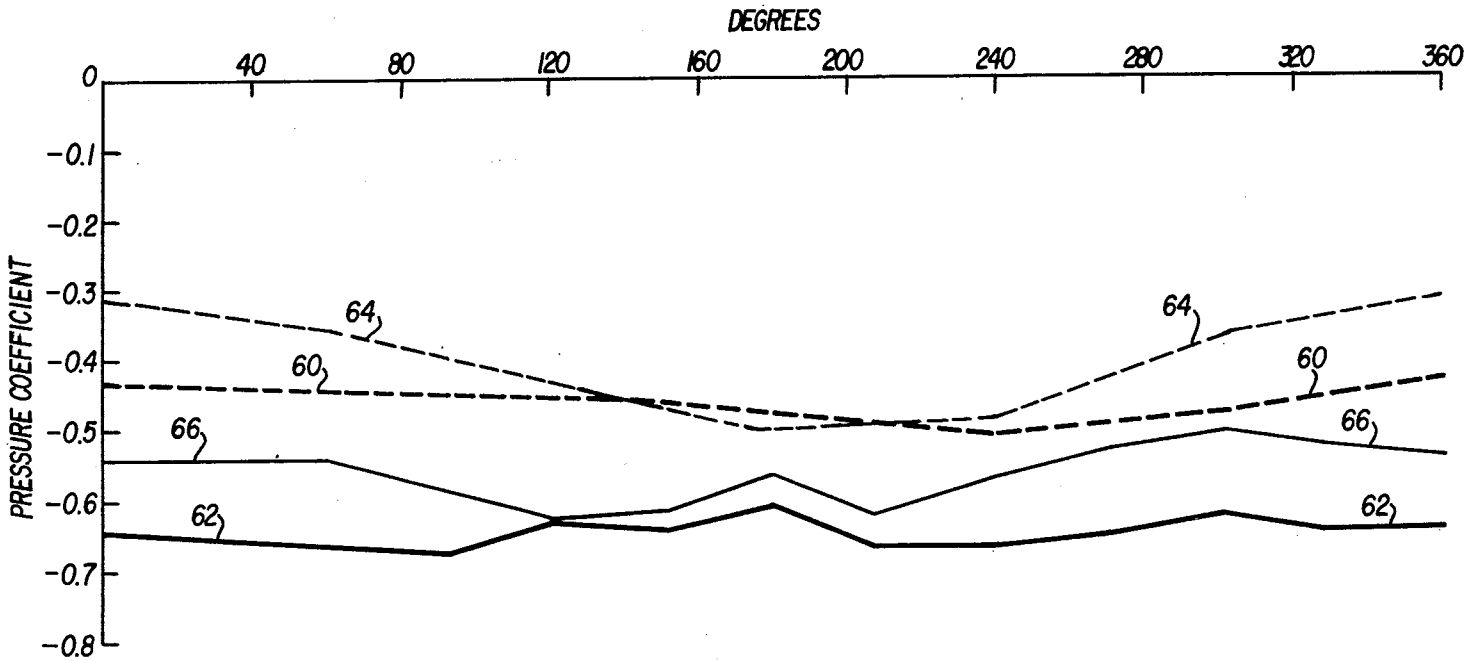
FIG. 4 is a graph illustrating circumferential pressure distribution at the last stage buckets of the turbine.

The exhaust hood construction employed in this invention achieves an improvement in last stage bucket efficiency by achieving a more uniform circumferential and radial pressure distribution in the exit plane of the last stage buckets. This is becoming of increasing importance for buckets of high tip speeds and high exit Mach numbers. This improvement can be seen by referring to FIG. 4 which illustrates in the dashed line 60 the cicumferential distribution of pressure from 0° thru 360° at the root of the last stage buckets and in the solid line 62 the similar circumferential distribution of pressure at the tip of the last stage buckets in an arrangement employing this invention. For comparison, FIG. 4 also shows similar circumferential pressure distribution at the root in the dashed line 64 and at the tip in the solid line 66 for an exhaust arrangement in which the secondary vane 44 of this invention are not employed. It can be seen by reference to FIG. 4 that the pressure distribution at both root and tip of the last stage bucket throughout the circumference thereof is relatively uniform with the structure of this invention whereas there is a significantly greater variation in the circumferential distribution of pressure at both the root and the tip without the use of the secondary vanes 44 of this invention.

Summarizing, the axial flow turbine and exhaust hood construction of this invention achieves a greater last stage bucket efficiency due to substantially uniform circumferential and radial pressure distribution in the exit plane of the last stage buckets, achieves a substantially uniform flow distribution across the area of the discharge opening 36 of the exhaust hood, and minimizes energy-consuming vortices and acceleration losses. Moreover, these results are obtained with the use of a relatively short axial length L of the exhaust hood.

While a specific embodiment of this invention has been disclosed, it is not intended to limit the invention to the particular construction shown and disclosed and it is intended by the appended claims to cover all modifications within the spirit and scope of this invention.

I claim:

1. A combined axial flow turbine and exhaust hood comprising:

a. an axial flow turbine having last stage buckets adjacent the exhaust from said turbine, b. an exhaust hood including an exhaust duct having an annular opening connected to said turbine adjacent said last stage buckets, said duct having an inner wall positioned approximately at the root of said last stage buckets and an outer wall positioned approximately at the tip of said last stage buckets, said exhaust duct receiving steam in an axial direction at said annular opening and being curved to direct said steam in a radial direction, c. a plurality of first curved vanes positioned in spaced relationship in said exhaust duct between said inner and outer walls thereof for directing the steam in a radial direction at the trailing ends of said vanes, d. a guide ring surrounding said vanes adjacent the trailing ends thereof, e. a plurality of curved secondary vanes positioned in spaced relationship in said guide ring, f. said exhaust hood having a radially extending discharge opening, g. said secondary vanes being curved by varying amounts for directing steam from said first vanes toward said discharge opening.

2. The apparatus of claim 1 wherein each of said secondary vanes includes a leading end and a trailing end extending at an angle to said leading end and wherein the angle between said leading end and said trailing end is a maximum for the vane positioned between approximately 90° and 110° from the top of said guide ring.

3. The apparatus of claim 1 wherein said angle progressively increases from a minimum at the topmost secondary vane to a maximum for the secondary vane positioned between approximately 90° and 110° form the top of said guide ring and progressively decreases to a second minimum at the lowermost secondary vane.

4. The apparatus of claim 1 wherein the axial length of each of said secondary vanes is a minimum at the radially inner end thereof and increases to a maximum at the radially outer end thereof for diffusing steam flowing over said secondary vanes.

5. The apparatus of claim 1 wherein said turbine includes a shaft and wherein the trailing end of each of said first vanes is at the same radial distance from the center of said shaft.

6. The apparatus of claim 1 wherein the number of said first vanes increases with increase in the ratio between the radius of the tip of said last stage turbine buckets and the radius of the root of said buckets.

7. The apparatus of claim 1 wherein said secondary vanes are substantially equally spaced circumferentially about said guide ring.

8. The apparatus of claim 7 wherein the ratio of radial width of said secondary vanes to the pitch of said secondary vanes is at least 0.86.

* * * * *